United States Patent [19]

Endo et al.

[11] 4,441,479

[45] Apr. 10, 1984

[54] IGNITION SYSTEM FOR A MULTI-CYLINDER INTERNAL COMBUSTION ENGINE OF A VEHICLE

[75] Inventors: Hiroshi Endo, Yokosuka; Masazumi Sone, Tokyo; Iwao Imai; Yasuki Ishikawa, both of Yokosuka, all of Japan

[73] Assignee: Nissan Motor Company, Limited, Yokohama, Japan

[21] Appl. No.: 403,360

[22] Filed: Jul. 30, 1982

[30] Foreign Application Priority Data

Aug. 6, 1981 [JP] Japan ..... 56-122390

[51] Int. Cl.[3] ..... F02P 5/00

[52] U.S. Cl. ..... 123/605; 123/620; 123/643; 123/609; 123/143 B

[58] Field of Search ..... 123/620, 602, 605, 609, 123/643, 143 B

[56] References Cited

U.S. PATENT DOCUMENTS 3,554,177 1/1971 Hufton et al. .
3,805,759 4/1974 Fitzner .
3,885,541 5/1975 Hufton .
3,952,715 4/1976 Van Siclen, Jr. ..... 123/602
4,170,207 10/1979 Boyama .
4,306,536 12/1981 Fitzner .
4,359,037 11/1982 Stangl ..... 123/643
4,366,801 1/1983 Endo et al. ..... 123/620
4,369,758 1/1983 Endo ..... 123/620
4,398,526 8/1983 Hamai et al. ..... 123/620
4,399,802 8/1983 Oshiage et al. ..... 123/620

*Primary Examiner*—Parshotam S. Lall
*Attorney, Agent, or Firm*—Schwartz, Jeffery, Schwaab, Mack, Blumenthal & Koch

[57] ABSTRACT

An ignition system for a multi-cylinder internal combustion engine having a spark plug within each engine cylinder, wherein a single DC-DC converter is provided and a high-voltage withstanding characteristic capacitor is provided for each spark plug. The capacitor charges to the high DC output voltage of the DC-DC converter and operatively supplies the high DC voltage via a boosting transformer into the corresponding spark plug at a predetermined ignition timing. The amount of the discharge energy is varied according to the pulse width of an input signal of each switching circuit which operates to supply the charged high DC voltage of the capacitor into the corresponding spark plug, the pulse width being varied according to various engine operating conditions.

5 Claims, 7 Drawing Figures

IGNITION SYSTEM FOR A MULTI-CYLINDER INTERNAL COMBUSTION ENGINE OF A VEHICLE

BACKGROUND OF THE INVENTION

1. Field of the Invention

The present invention relates to an improvement of an ignition system for an internal combustion engine of an automotive vehicle having a plurality of engine cylinders, wherein a voltage boosting means is provided for boosting a low DC voltage into a high DC voltage, a high-voltage withstanding capacitor is provided for a spark plug within each engine cylinder so as to charge the boosted high DC voltage, and operatively supplies the charged high DC voltage via a boosting transformer into the corresponding spark plug as a discharge energy at a predetermined ignition timing, the amount of discharge energy changing according to various engine operating conditions so as to provide an appropriate amount of ignition energy for each spark plug.

2. Description of the Prior Art

A conventional ignition system comprises: (a) a low DC voltage supply such as a vehicle battery; (b) an ignition coil having a primary winding and secondary winding, one end of the primary winding being connected to the plus electrode of the low DC voltage supply and the other end of the primary winding being connected to one end of the secondary winding; (c) a contact point which opens and closes in synchronization with the engine revolution, one end of contact point being connected to the common end of both primary and secondary windings and the other end being grounded; and (d) a distributor having fixed contacts and a rotor, the rotor being rotated in synchronization with the engine revolution and being brought in contact with one of the fixed contacts sequentially one rotation of the rotor corresponding to one engine cycle, and each fixed contact being connected to a corresponding spark plug within one of the engine cylinders via a high-tension cable.

In such a construction described above, when a DC current flowing through the primary winding of the ignition coil from the low DC voltage supply is interrupted by the contact point, a high surge voltage having a peak value of several ten kilovolts is produced at the secondary winding thereof. The high surge voltage is applied to the distributor. The distributor distributes the high surge voltage into one of the spark plugs when the rotor comes in contact with the corresponding fixed contact.

However, such a conventional ignition system has a drawback that the transmission loss from the low DC voltage supply to the spark plugs is as large as, e.g., 80 to 90 percent of the power that the battery of the low DC voltage supply provides, and inductive energy at the primary winding of the ignition coil cannot be varied according to the engine operating condition. Therefore, the ignition energy cannot easily be varied according to the engine operating condition so that total power consumption increases. On the other hand, if the ignition energy is decreased by, e.g., reducing the inductance of the ignition coil so as to save total power consumption, a stable combustion cannot be achieved in the case of lean air-fuel mixture ratio ($A/F \geqq 18$).

SUMMARY OF THE INVENTION

With the above-described drawback in mind, it is an object of the present invention to provide an ignition system for a multi-cylinder engine, wherein a voltage booster is provided for producing a high DC voltage from a low DC voltage and the high DC voltage is charged within each capacitor provided for the corresponding engine cylinder, the high DC voltage charged within the capacitor being sequentially supplied into one spark plug within the corresponding cylinder via a boosting transfomer as a discharge energy at a predetermined ignition timing so that the amount of discharge energy is appropriately controlled according to various engine operating conditions, whereby total power consumption can be saved and a stable combustion of air-fuel mixture of any air-fuel mixture ratio supplied into each engine cylinder can be achieved under any engine operating condition.

BRIEF DESCRIPTION OF THE DRAWINGS

The features and advantages of the present invention will be appreciated from the foregoing description in conjunction with the attached drawings in which like reference numerals designate corresponding elements and in which.

DETAILED DESCRIPTION OF THE PREFERRED EMBODIMENT

Reference will hereinafter be made to the attached drawings to facilitate an understanding of the present invention.

Figure 1:
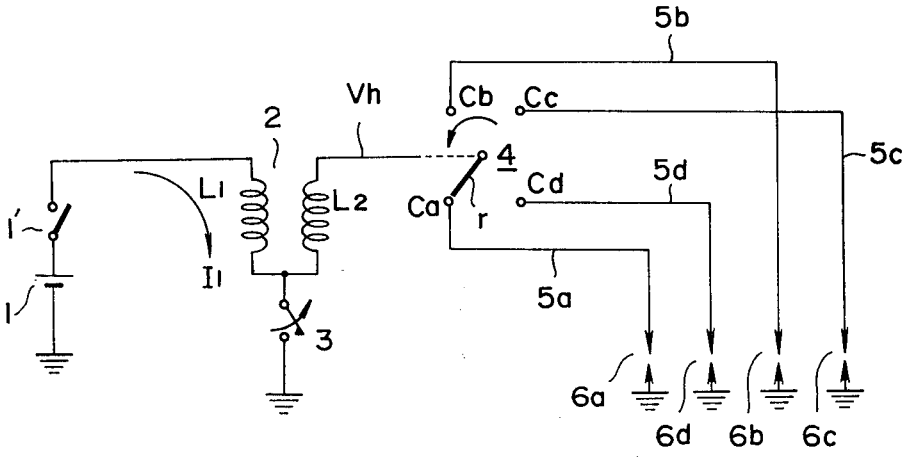
FIG.1 PRIOR ART
FIG. 1 is a simplified circuit diagram of a conventional ignition system for a mutli-cylinder internal combustion engine.

FIG. 1 shows a conventional ignition system for a multi-cylinder engine particularly a four-cylinder engine. In FIG. 1, numeral 1 denotes a low DC voltage supply such as a vehicle battery, a minus electrode being grounded. Numeral 1' denotes an ignition switch. Numeral 2 denotes an ignition coil having a primary winding $L_1$ and secondary winding $L_2$. One end of the primary winding $L_1$ is connected to the plus electrode of the low DC voltage supply 1 via the ignition switch 1' and the other end thereof is connected to one end of the secondary winding $L_2$. The common end of both primary and secondary windings $L_1$ and $L_2$ is grounded via a contact breaker 3. The contact breaker 3 opens and closes repeatedly according to the engine revolution. The other end of the secondary winding $L_2$ is connected to a distributor 4. The distributor 4 comprises a rotor r which rotates in synchronization with the engine revolution and a plurality of fixed contacts $C_a$ through $C_d$ located around the rotor at equal intervals and each connected to one of spark plugs 6*a* through 6*d* according to the ignition order via each high-tension cable 5*a* through 5*d*. When the ignition switch 1′ is closed, the DC current $I_1$ flows through the primary winding $L_1$ of the ignition coil 2 with the contact breaker 3 turned on. When the breaker 3 interrupts the current $I_1$, a high surge voltage $V_h$ is produced at the secondary winding thereof and outputted into the distributor 4. The high surge voltage $V_h$ has a peak value of several ten kilovolts enough to generate the spark discharge. The distributor 4 distributes the high surge voltage into one of the spark plugs 6*a* through 6*d* according to the ignition order so as to perform a fuel combustion at the corresponding engine cylinder.

Figure 2A:
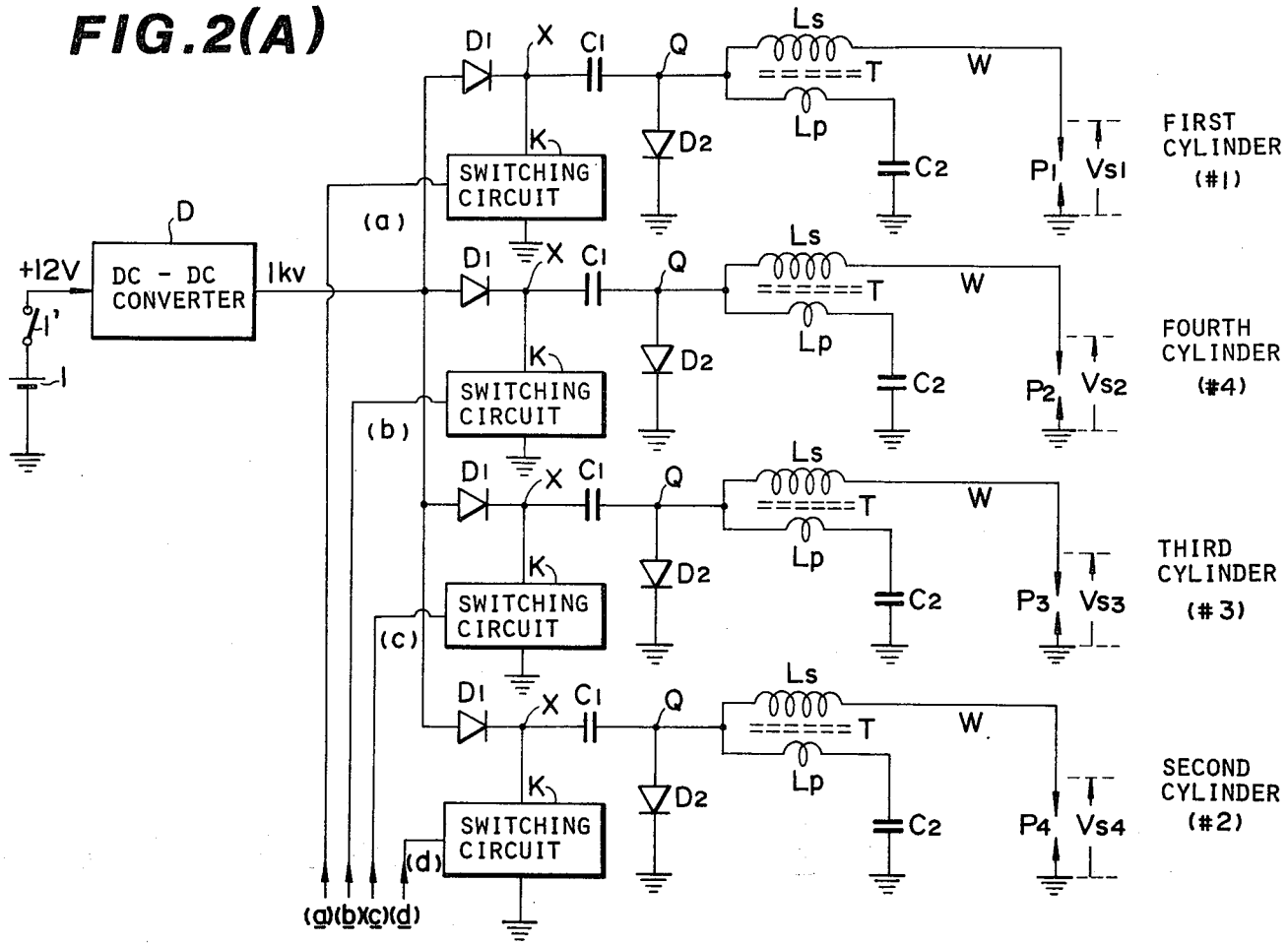
FIGS. 2(A) and 2(B) are in combination a simplified circuit diagram of a preferred embodiment of the ignition system according to the present invention.
Figure 2B:
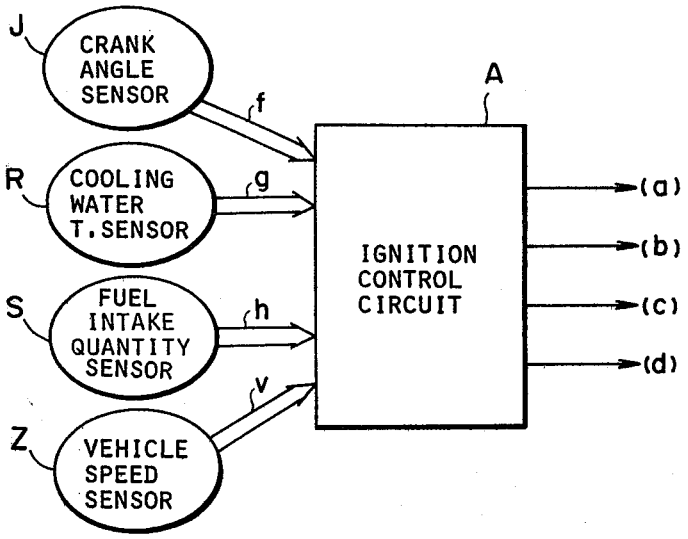

FIGS. 2(A) and 2(B) show in combination a preferred embodiment according to the present invention. In this embodiment, a DC-DC converter D is connected to the ignition switch 1′. The DC-DC converter D inverts the low DC voltage, e.g., 12 volts into a corresponding AC voltage using an oscillator and boosts and converts the AC voltage into a high DC voltage, e.g., 1 kilovolt. The output terminal of the DC-DC converter D is connected to a plurality of first capacitors $C_1$ equal in number to the engine cylinders (in this case, the number of engine cylinders are four as shown in FIG. 2(A)). When the high DC voltage charges the first capacitors $C_1$, one end of each first capacitor $C_1$ is grounded in potential via each attached second diode $D_2$. It will be seen that at this time switching circuits K are turned off. Each end of the first capacitors $C_1$ is also connected to a common terminal of corresponding boosting transformer T. Each boosting transformer T comprises a primary winding $L_p$, one end being the common terminal with one end of a secondary winding $L_s$, the other end of the primary winding $L_p$ being grounded via a second capacitor $C_2$. The other end of each secondary winding $L_s$ is connected to the corresponding spark plug $P_1$ through $P_4$. Each spark plug $P_1$ through $P_4$ has a side electrode being grounded and a central electrode being connected to the other end of the corresponding secondary winding $L_s$. The winding ratio of each primary winding $L_p$ and secondary winding $L_s$ is 1:N. In this embodiment, an ignition control circuit A is provided which is connected to a trigger input terminal of each switching circuit K. The ignition control circuit A responds to respective output signals f, g, h, and v from a crank angle sensor J, engine cooling water temperature sensor R, fuel intake quantity sensor S, and vehicle speed sensor Z and controls the amount of discharge energy to be fed from each first capacitor $C_1$ into each spark plug $P_1$ through $P_4$ so as to provide an optimum amount of discharge energy for each spark plug according to the engine operating condition detected by such sensors.

The crank angle sensor J outputs reference signals, e.g., 180° signal having a period corresponding to 180° revolution of an engine crankshaft in the case of the four cylinders and 720° signal having a period corresponding to one engine cycle based on the calculation of an optimum ignition timing by the control circuit A. At the same time, the control circuit A receives the output signals corresponding to the engine cooling water temperature, fuel intake quantity, and vehicle speed each representative of the current engine operating condition. It should be noted that the crank angle sensor J outputs another reference signal having a pulse widths corresponding to 1° of the crankshaft revolutional angle for detecting the engine speed.

The respective switching circuits K turn on to ground the corresponding end of the respective first capacitors $C_1$ which have been with the high DC voltage supplied from the DC-DC converter D when they receive the respective trigger pulse signals whose pulse widths are calculated by the ignition control circuit A according to the output signals from such sensors J, R, S and Z. In this embodiment, each switching circuit K turns on when the corresponding trigger pulse signal (a) through (d) is active, i.e., changes its level from a logical "1" to a logical "0". It should be noted that each switching circuit K continues to turn on during the pulse width of the inputted trigger pulse signal (a) through (d). During the turning-on state of each switching circuit K, the electric charge within the corresponding first capacitor $C_1$ is sent into the corresponding spark plug $P_1$ through $P_4$ via the corresponding boosting transformer $T_1$ through $T_4$.

For example, in the first cylinder (#1) shown in FIG. 2(A), the corresponding switching circuit K turns on in response to the active state of the corresponding trigger pulse signal (a), i.e., when the trigger pulse signal (a) changes its level from a logic "1" to a logic "0" with the corresponding first capacitor $C_1$ being charged with a high voltage of 1 kilovolt supplied from the DC-DC converter D via corresponding first diode $D_1$. The potential of point X changes from 1 kilovolt to zero, and point Q changes from zero to minus 1 kilovolt. The corresponding second diode $D_2$ then becomes non-conductive. At this time, the voltage change of 1 kilovolt is applied across the primary winding $L_p$ and second capacitor $C_2$ of the corresponding boosting transformer section T. It will be appreciated that a damping oscillation having a frequency, $f_p$ expressed by the equation:

$$f_p \approx \frac{1}{2\pi\sqrt{L_p \cdot C_2}}$$

occurs thereat. The capacitance value of the second capacitor $C_2$ is lower than that of the first capacitor $C_1$. When such a transient phenomenon occurs at the primary winding $L_p$ (the maximum amplitude of the damping oscillation voltage is ±1 KV), an alternating voltage having a maximum amplitude of ±N kilovolts (determined by the winding ratio of the boosting transformer T, i.e., 1:N) is generated at the secondary winding $L_s$ thereof. The alternating voltage thus generated is applied across the first spark plug $P_1$. Therefore, an air-fuel mixture within a discharge gap of the first spark plug $P_1$ breaks down so that the resistance of the discharge gap becomes substantially zero, i.e., conductive. With the discharge gap of the first spark plug $P_1$ conductive, a sufficient discharge energy $E_x$ which is part of the high energy of about 250 milijoules ($\frac{1}{2}CV^2 = \frac{1}{2} \times 0.5 \times 10^{-6}(F) \times 10^6$) stored within the first capacitor $C_1$ is fed into the discharge gap of the first spark plug $P_1$ via the secondary winding $L_s$ of the corresponding boosting transformer T in a short interval of time (0.2 milliseconds) only during the time corresponding to the pulse width of the trigger pulse signal (a) inputted into the corresponding switching circuit K. Along with the feed of the discharge energy $E_x$ into the first spark plug $P_1$, a plasma gas is generated at the discharge gap so that the air-fuel mixture supplied into the first cylinder can be ignited and fired.

It should be noted that the turning-on order of the switching circuits K is determined by the ignition control circuit A. For example, in the case of the four cylinder engine, the order of outputting the trigger pulse signals (a) through (d) corresponds to the first, fourth, third, and second cylinders.

Figure 3:
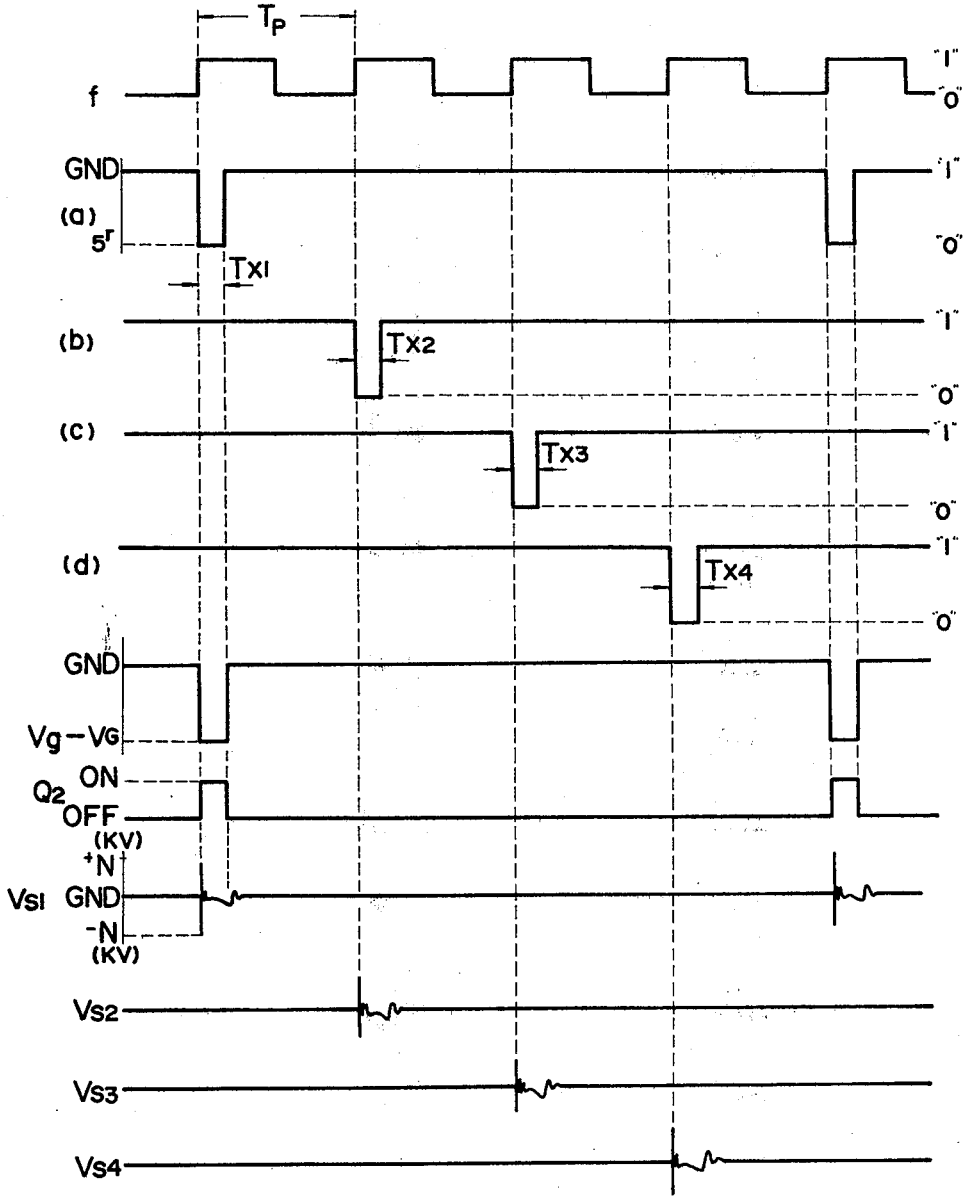
FIG. 3 is a timing chart of each output signal of the essential circuit blocks shown in FIGS. 2(A) and 2(B)

It should be noted that in this embodiment, the logic "1" corresponds to the voltage level of zero volt and logic "0" corresponds to the voltage level of minus five volts as shown in FIG. 3.

In addition, as described hereinbelow each switching circuit K comprises a second field effect transistor $Q_2$ of N-channel type whose gate terminal is connected to a collector terminal of a first transistor $Q_1$ and to a minus bias supply $-V_G$ via a resistor $R_2$, drain terminal is connected to the point X shown in FIG. 2(A) and source terminal is connected to the ground.

FIG. 3 shows signal waveforms at each circuit shown in FIGS. 2(A) and 2(B).

Figure 4:
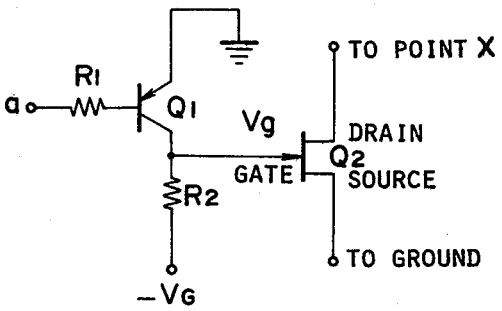
FIG. 4 is a circuit diagram showing an example of a switching circuit K shown in FIG. 2(A)

FIG. 4 shows an example of each switching circuit K shown in FIG. 2(A).

As shown in FIG. 4, each switching circuit K further comprises the first transistor $Q_1$ of PNP type which turns on when the corresponding trigger pulse signal (a) through (d) whose signal waveform is shown in FIG. 3 is received from the ignition control circuit A via a resistor $R_1$. The second transistor $Q_2$ having a high-voltage withstanding characteristic conducts when the first transistor $Q_1$ turns on and gate potential becomes the minus bias supply voltage $-V_G$. As described hereinabove, when the second transistor $Q_2$ conducts, the point X is grounded so that the corresponding end of the first capacitor $C_1$ changes its voltage level from 1 kilovolt to zero. After the trigger pulse signal changes its level from a "0" to a "1", the first transistor $Q_1$ turns off and correspondingly the second transistor $Q_2$ becomes non-conductive. Therefore, the conducting interval of time of the second transistor $Q_2$ depends on the pulse width $T_x$ of the inputted trigger pulse signal (a) through (d).

When the second transistor $Q_2$ becomes non-conductive, the path of supplying the discharge energy $E_x$ from the corresponding first capacitor $C_1$ to the corresponding spark plug $P_1$ through $P_4$ is interrupted. However, the discharge phenomenon continues until a response delay of $\tau$.

Figure 5:
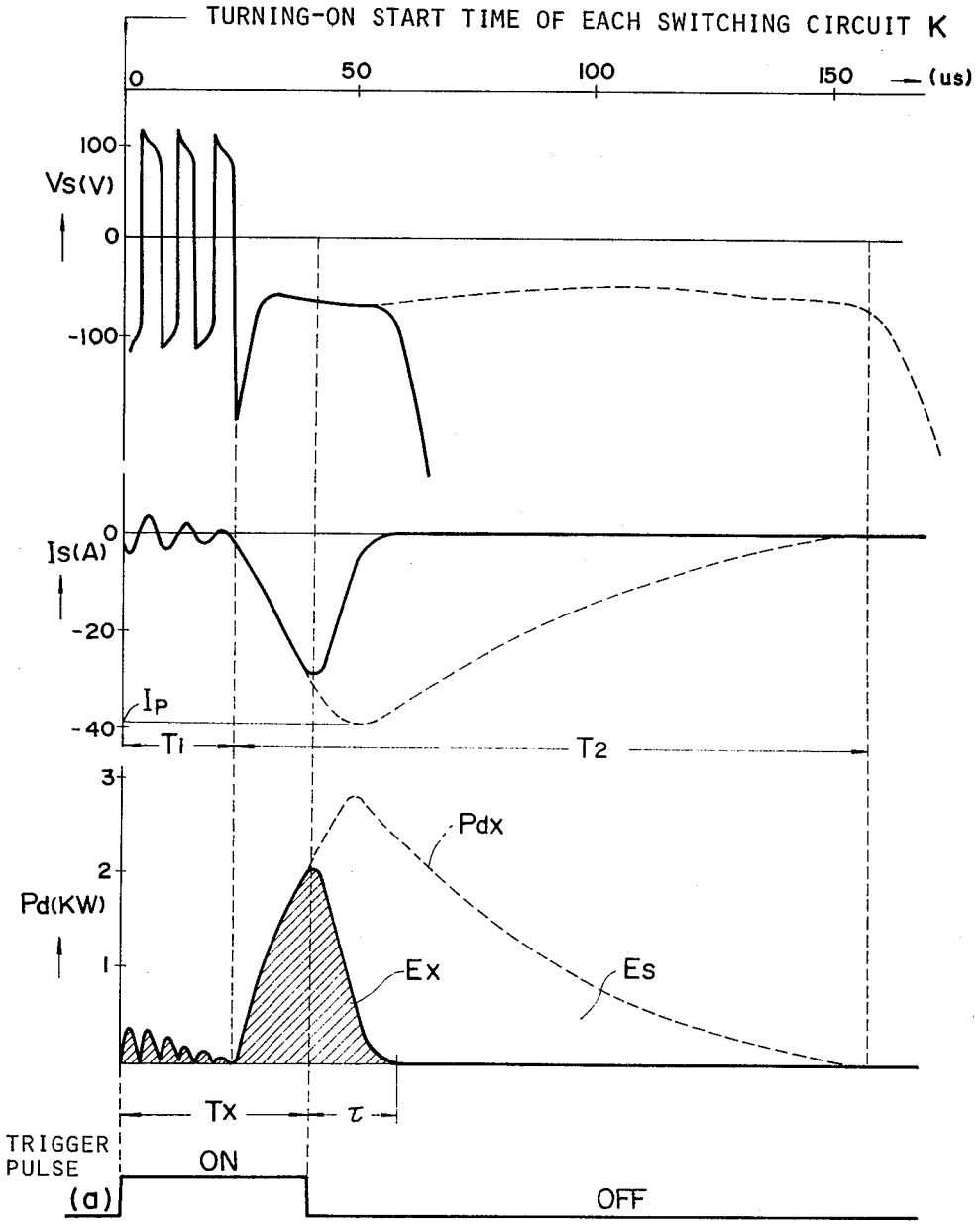
FIG. 5 is a discharge pattern of each spark plug P shown in FIG. 2(A)
Figure 6:
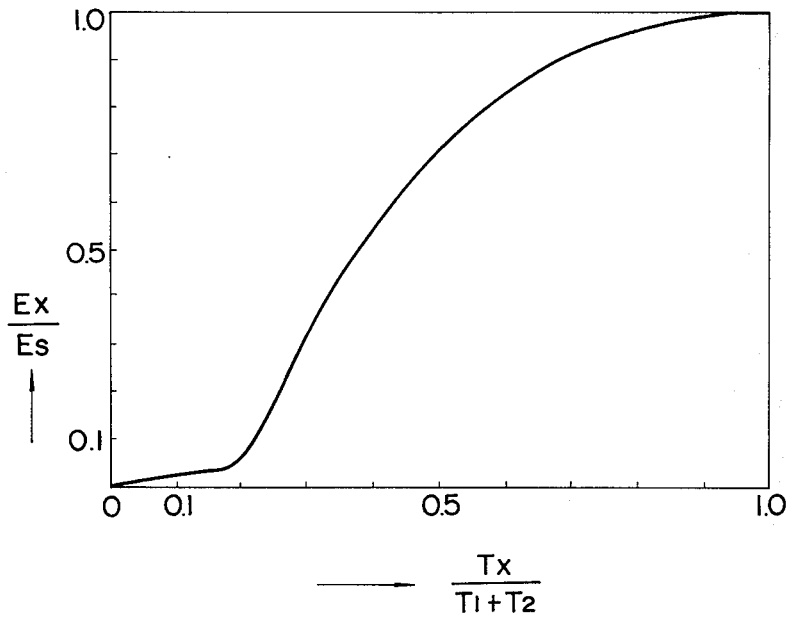
FIG. 6 is a characteristic grap representing the relationship between the turn-on interval of a switching circuit K and discharge energy.

FIG. 5 shows a discharge pattern of the representative spark plug.

In FIG. 5, each waveform indicated by solid line appears when the discharge is forcibly stopped by narrowing the pulse width $T_x$ of the representative trigger pulse signal (a) through (d). On the other hand, each waveform indicated a dotted line appears when the charged energy within the first capacitor $C_1$ is fully (100%, i.e., about 250 millijoules) fed into the corresponding spark plug $P_1$ through $P_4$.

In FIG. 5, $V_s$ denotes a discharge voltage, $I_s$ denotes a discharge current, and Pd denotes a discharge power.

As appreciated from FIG. 5, if the discharge interval of time is $T_1$ (about 25 microseconds), an alternating arc discharge occurs. During the subsequent discharge interval of time $T_2$ (about 115 microseconds from the elapse time of 25 microseconds), a large current having a peak value $I_p$ of about 40 amperes flows through the spark plug $P_1$ through $P_4$ so as to generate a subsequent arc discharge. The interval of time within which the arc discharge occurs is totally about 160 microseconds.

In the case when the charged energy within the first capacitor $C_1$ is fully discharged into the corresponding spark plug $P_1$ through $P_4$, i.e., in the case of the discharge energy indicated by the dotted lines in FIG. 5, the total discharge energy $E_s$ can be expressed as:

$$E_s = \int_0^{T_1 + T_2} Pd\,dt$$

The calculated result equals approximately 150 millijoules.

In this way, the ignition system according to the present invention can supply a remarkably high discharge energy into the spark plug $P_1$ through $P_4$ in an extremely short time.

Consequently, a stable combustion of a lean air-fuel mixture having an air-fuel mixture ratio of about 20:1 can be assured.

A power efficiency $\eta_p$ of the DC-DC converter is approximately 80 percent and power efficiency of an ignition circuit F for each engine cylinder comprising: (a) the first capacitor section $C_1$ having the first and second diodes $D_1$ and $D_2$; (b) switching circuit K; and (c) the boosting transformer section T is expressed as $$\eta f_1 = \frac{E_s}{\text{charging energy of the first capacitor } C_1} = \frac{E_s}{\frac{1}{2}C \cdot V^2} \approx \frac{150\text{ mJ}}{250\text{ mJ}} = 60\%$$

Therefore, a total power efficiency can be obtained as $\eta T = \eta p \times \eta f \approx 50\%$. In this way, the power efficiency of the ignition system according to the present invention is remarkably increased as compared with the other conventional systems particularly in FIG. 1. If the total discharge energy $E_s$ is maximized, the power consumption of the low DC voltage supply 1 is substantially the same as the conventional ignition system particularly in FIG. 1. In addition, when the engine operates the discharge energy is controlled to a minimum amount of energy consumption depending on the particular engine operating condition. Hence, the power consumption can remarkably be saved.

The discharge stops an interval of time $\tau$ (about 20 microseconds) later than the turning off of the switching circuit K due to the response characteristic of the discharge circuit comprising the secondary winding $L_s$ and first capacitor $C_1$. A discharge energy $E_x$ supplied into the spark plug $P_1$ through $P_4$ during an interval of time; i.e., $T_x \times \tau$ is expressed as:

$$E_x \doteqdot \int_0^{T_x + \tau} Pd_x \cdot dt$$

The discharge energy $E_x$ described above corresponds to an area indicated by oblique lines in FIG. 5.

Furthermore, when the pulsewidth $T_x$ of each trigger pulse signal (a) through (d) is varied, the discharge energy $E_x$ varies in a range from 0 to 150 millijoules if the pulse width $T_x$ changes from zero to $T_1 + T_2$.

Therefore, the ignition control circuit A calculates and determines the particular engine operating condition on the basis of the output signals f, g, h, v, from the crank angle sensor J, cooling water temperature sensor R, fuel intake quantity sensor S, vehicle speed sensor Z, etc. and outputs one of the trigger pulse signals (a) through (d) sequentially having the calculated pulse width $T_x$ ($T_x = f(f,g,h,v)$), into the corresponding switching circuit K. The optimum amount of discharge energy $E_x$ ($E_x = g(f,g,h,v)$) can thus be supplied into the corresponding spark plug $P_1$ through $P_4$ according to various engine operating conditions; e.g., the discharge energy $E_x$ increases at the time of low engine speed and at the time of engine acceleration and decreases at the time of constant engine speed and at the time of engine deceleration.

It will be understood by those skilled in the art that the foregoing description is in terms of preferred embodiments of the present invention wherein various changes and modifications may be made without departing from the spirit and scope of the present invention, which is to be defined by the appended claims.

What is claimed is:

1. An ignition system for a multi-cylinder internal combustion engine of an automotive vehicle having a plurality of spark plugs, each installed into the corresponding engine cylinder, comprising:

(a) a low DC voltage supply;

(b) a DC-DC converter which boosts a low DC voltage from said low DC voltage supply into a high DC voltage;

(c) a plurality of first capacitor sections each having a first diode connected to said DC-DC converter, a first capacitor one end thereof being connected to said first diode, and a second diode being connected between the other end of said first capacitor and ground, each of said first capacitors charged by said high DC voltage;

(d) a plurality of switching circuits, each connected between said one end of said first capacitor and ground which operatively grounds the end of said first capacitor so as to discharge the energy charged within said first capacitor;

(e) a plurality of boosting transformer sections, each connected between said corresponding first capacitor section and spark plug and having a primary winding and secondary winding, one end of said primary winding being connected to the other end of said first capacitor together with one end of said secondary winding thereof, the other end of said primary winding being grounded via a second capacitor so as to generate a damping oscillation when said corresponding switching circuit turns on to apply the charged high DC voltage thereacross, and the other end of said secondary winding being connected to the corresponding spark plug so as to boost the voltage applied across said primary winding so as to supply a discharge energy into the corresponding spark plug; and (f) an ignition control circuit which receives ignition reference signals in synchronization with the engine speed from a crank angle sensing means attached around an engine crankshaft, an engine cooling water temperature signal corresponding to engine cooling water temperature from an engine cooling water temperature sensing means, an engine fuel intake quantity signal corresponding to fuel intake flow rate from fuel intake quantity sensing means, and a vehicle speed signal corresponding to the vehicle speed from a vehicle speed sensing means and calculates an optimum output timing and a pulse width of each output signal therefrom into said corresponding switching circuit on a basis of input signals from said sensing means, the respective output signals being sent into said switching circuits sequentially according to the ignition order at the calculated optimum output timing and pulse width thereof corresponding to the interval of time during which said corresponding switching circuit is maintained on, whereby the discharge energy supplied into the respective spark plugs changes according to the engine operating conditions so as to provide an optimum discharge energy for the respective spark plugs.

2. An ignition system as set forth in claim 1, wherein said ignition control circuit increases the pulse width of the output signal from said ignition control circuit at the time of low engine speed and at the time of vehicle acceleration in response to said sensing means so as to increase the discharge energy from said first capacitor to the corresponding spark plugs.

3. An ignition system as set forth in claim 1 or 2, wherein said ignition control circuit decreases the pulse width of the respective output signals from said ignition circuit at the time of a constant vehicle running and at the time of vehicle deceleration in response to said sensing means so as to decrease the discharge energy from said first capacitor to the corresponding spark plug.

4. An ignition system as set forth in claim 1, wherein each of said switching circuits comprises;

(a) a first transistor section which turns on in response to the sequential output signal from said ignition control circuit; and (b) a second transistor section connected between one end of said corresponding first capacitor and ground which grounds the end of said first capacitor when said first transistor turns on.

5. An ignition system as set forth in claim 4, wherein said second transistor section comprises a field effect transistor having a high-voltage withstanding characteristic.

* * * * *